US006735318B2

(12) United States Patent
Cho

(10) Patent No.: US 6,735,318 B2
(45) Date of Patent: May 11, 2004

(54) MIDDLE EAR HEARING AID TRANSDUCER

(75) Inventor: Jin-ho Cho, Kyungsangbuk-do (KR)

(73) Assignee: Kyungpook National University Industrial Collaboration Foundation, Dae-gu (KR)

( * ) Notice: Subject to any disclaimer, the term of this patent is extended or adjusted under 35 U.S.C. 154(b) by 141 days.

(21) Appl. No.: 09/832,176

(22) Filed: Apr. 11, 2001

(65) Prior Publication Data

US 2001/0055405 A1 Dec. 27, 2001

(51) Int. Cl.[7] ..... H04R 25/00

(52) U.S. Cl. ..... 381/326; 381/322; 381/324; 381/23.1; 600/25; 29/605

(58) Field of Search ..... 381/322, 324, 381/331, 326, 328, 320, 23.1; 600/25, 23, 28, 559; 607/55–57; 29/605

(56) References Cited

U.S. PATENT DOCUMENTS 5,460,593 A * 10/1995 Mersky 6,217,508 B1 * 4/2001 Ball

* cited by examiner

*Primary Examiner*—Curtis Kuntz
*Assistant Examiner*—Dionne Harvey
(74) *Attorney, Agent, or Firm*—Lowe Hauptman Gilman & Berner LLP

(57) ABSTRACT

A middle ear hearing aid transducer is provided. The middle ear hearing aid includes: first and second permanent magnets arranged such that the same poles face each other; a coil separated a predetermined distance from the outer surfaces of the first and second permanent magnets, and surrounding the first and second permanent magnets; a case for accommodating the first and second permanent magnets and the coil; and a vibration member for supporting the first and second permanent magnets to keep a predetermined distance between the coil and the outer surfaces of the first and second permanent magnets, and for transmitting vibrations of the first and second permanent magnets to the case.

7 Claims, 10 Drawing Sheets

MIDDLE EAR HEARING AID TRANSDUCER

BACKGROUND OF THE INVENTION

1. Field of the Invention

The present invention relates to a middle ear hearing aid transducer which can be easily introduced into the middle ear, and whose sensitivity can be maintained after extensive use without contamination by foreign substances.

2. Description of the Related Art

Many types of hearing aids are available including an external type which is disposed in the external auditory canal or behind an auricle, and an inner and middle ear implant types which are accompanied with surgery. In addition, there are temporal bone conduction hearing aids which produce mechanical vibrations from sound waves and transmit the mechanical vibrations to the inner ear via a temporal bone. In particular, middle ear implant hearing aids are extensively used to remedy moderate or extreme hearing loss or sensorineural hearing loss.

FIG. 1 shows a conventional middle ear hearing aid whose transducer is implanted into a patient's staples, and FIG. 2 is a perspective view of the transducer of FIG. 1. As shown in FIG. 1, the conventional middle ear hearing aid includes an external unit 10, which is worn behind the patient's auricle, and an internal unit 20, which is implanted in the outer ear and middle ear. In particular, the external unit 10 includes a microphone 11, amplification circuitry 12, a battery 13, and an external coupling coil 14. The internal unit 20 includes internal circuitry (not shown) adjacent to the external coupling coil 14, an internal coupling coil 24, and a transducer 25, which is implanted into a stapes 8 or malleus 9 of the ossicular chain in the middle ear.

Referring to FIG. 2, the transducer 25 includes a coil portion 26 fixed to a bone of the middle ear and a permanent magnet 27 implanted into the stapes 8 or malleus 9. The coil member 26 includes a support 26*a* fixed to a bone of the middle ear and a coil 26*b* supported by the support 26*a* and facing the permanent magnet 27. As sound waves are converted into electrical signals by the internal coupling coil 24 and transmitted to the coil 26*b*, the coil 26*b* generates a magnetic flux to vibrate the permanent magnet 27 implanted into the stapes 8.

In the hearing aid having the configuration described above, the microphone 11 and the amplification circuitry 12 of the external unit 10 receives and amplifies external sound waves. The amplified sound waves are transformed into electrical signals and transmitted to the external coil coupling coil 14. The external coupling coil 14 generates electromagnetic waves corresponding to the electrical signals and transmits the electromagnetic waves to the internal coupling coil 24. The internal circuitry converts the transmitted electromagnetic waves into electrical signals and transmits the electrical signals to the coil portion 26. The coil portion 26 generates a magnetic flux corresponding to the electrical signals to vibrate the permanent magnet 27 and the stapes 8 or malleus to which the permanent magnet 27 is fixed. Through these processes, a patient having a hearing disorder can perceive sound transmitted from the outside.

In the transducer 26 having the configuration described previously, the coil 26*b*, which generates the magnetic flux, is an air-core coil supported by the support 26*a*. The magnetic flux generated by the coil 26*b* is not capable of causing large vibrations in the permanent magnet 27. Thus, the transducer 26 with the air-core coil is not suitable for a patient with a serious hearing disorder.

To increase the magnetic flux, an iron core can be inserted into the coil 26*b*. In this case, even when no signal is input to the coil 26*b*, a stress is exerted upon the ossicular chain due to continuous attraction between the iron core and the permanent magnet 27 fixed to the ossicles. The ossicular chain, which is a highly sensitive organ of the body, is susceptible to damage caused by the attractive force between the permanent magnet 27 and the iron core. If the damage is serious, the sound wave transmission path may deform close to the entrance of the inner ear.

The coil 26*b* and the permanent magnet 27 are spaced a predetermined distance a part. The gap between the coil 26*b* and the permanent magnet 27 should be kept constant to allow the permanent magnet 27 to vibrate. If a fluid or foreign substance sticks to the coil 26*b* or the permanent magnet 27, the gap becomes narrower, interrupting vibrations of the permanent magnet 27. As a result, a patient who has a hearing disorder will not be able to perceive sound. Thus, there is a need for the gap between the coil 26*b* and the permanent magnet 27 to be kept constant even after extensive use.

In addition, in the conventional hearing aid having the configuration described above, the support 26*a* for the coil 26*b* and the permanent magnet 27 are implanted into bones in the middle ear by surgery, increasing concern about deformation of the middle ear. Thus, there is a need for a hearing aid which can be easily mounted into the middle ear without causing deformation of the middle ear.

SUMMARY OF THE INVENTION

To address the above limitations, it is an object of the present invention to provide a middle ear hearing aid transducer which can be kept sensitive to a small sound wave without contamination by fluid or foreign substance.

It is another object of the present invention to provide a middle ear hearing aid transducer which can be easily introduced into the middle ear without causing deformation of the sound wave transmission path.

The objects of the present invention are achieved by a middle ear hearing aid transducer comprising first and second permanent magnets arranged such that the same poles face each other; a coil separated a predetermined distance from the outer surfaces of the first and second permanent magnets, and surrounding the first and second permanent magnets; a case for accommodating the first and second permanent magnets and the coil; and a vibration member for supporting the first and second permanent magnets to keep a predetermined distance between the coil and the outer surfaces of the first and second permanent magnets, and for transmitting vibrations of the first and second permanent magnets to the case.

It is preferable that the vibration member comprises: a circular plate interposed between the first and second permanent magnets in the case; and supports disposed on the circular plate for supporting one end of the first and second permanent magnets, and the vibration member is an elastic member for suspending the first and second permanent magnets separated from the coil in the case. It is preferable that the circular plate and the supports are formed as a single unit.

Alternatively, the vibration member may comprise first and second vibration members interposed between the ends of the case and one end of the first and second permanent magnets, respectively, and the vibration member may be an elastic member for suspending the first and second permanent magnets separated from the coil in the case.

Alternatively, the vibration member may comprise first and second vibration members having a plurality of holes and interposed between the ends of the case and one end of the respective first and second permanent magnets, respectively, and the vibration member may be an elastic member for suspending the first and second permanent magnets separated from the coil in the case.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 3:
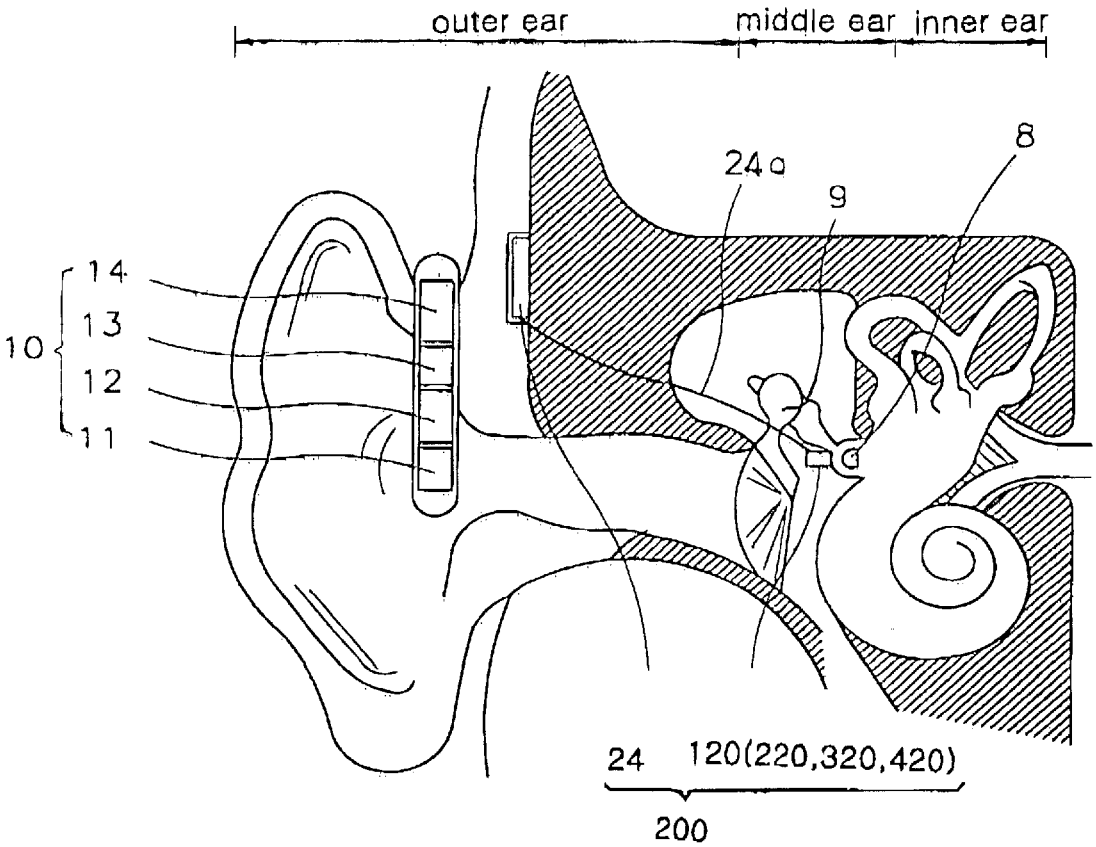
FIG. 3 shows a middle ear hearing aid according to a preferred embodiment of the present invention, in which a transducer is introduced into a patient's stapes.

A middle ear hearing aid according to a preferred embodiment of the present invention is shown in FIG. 3, in which a transducer is attached to a patient's stapes. As shown in FIG. 3, the middle ear hearing aid includes an external unit 10, which fits behind a patient's auricle, and an internal unit 200, which is introduced into the outer ear and the middle ear. In particular, the external unit 10 includes a microphone 11, amplification circuitry 12, a battery 13, and an external coupling coil 14. The internal unit 200 includes an internal coupling coil 24 adjacent to the external coupling coil 14, internal circuitry (not shown), and a transducer 120 attached to one of the three bones of the ossicular chain, for example, a stapes 8.

Figure 4:
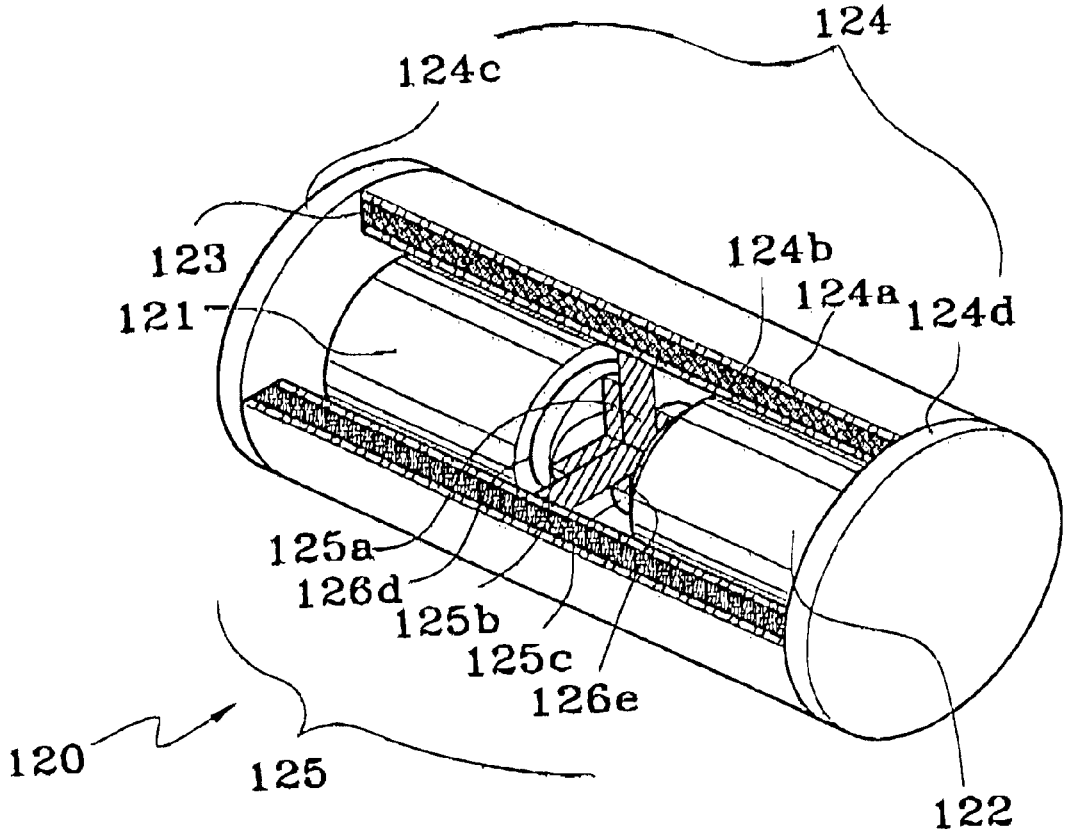
FIG. 4 is an exploded perspective view of a first embodiment of the transducer of FIG. 3.
Figure 5:
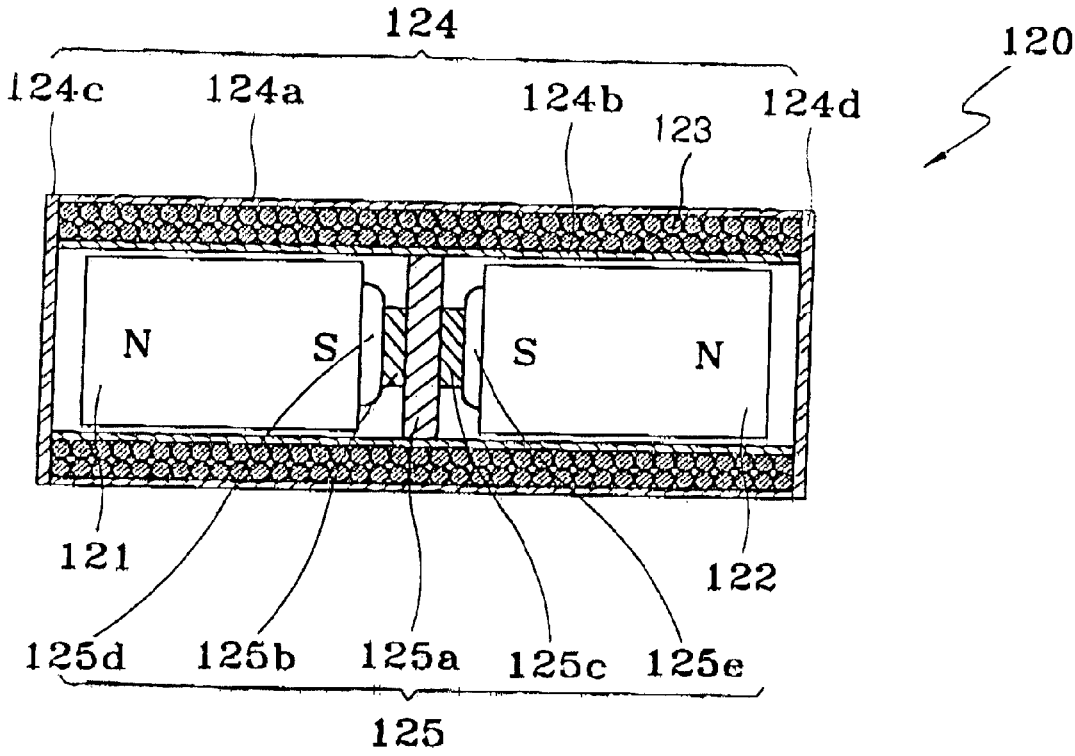
FIG. 5 is a sectional view of the transducer of FIG. 4.

FIG. 4 is an exploded perspective view of a first embodiment of the transducer of FIG. 3, and FIG. 5 is a sectional view of the transducer of FIG. 4. As shown in FIGS. 4 and 5, the transducer 120 includes first and second permanent magnets 121 and 122, which are arranged such that the same poles face each other; a coil 123 enclosing the first and second permanent magnets 121 and 122 but not contacting the outer surface of the first and second permanent magnets 121 and 122; a case 124 for accommodating the first and second permanent magnets 121 and 122 and the coil 123; and a vibration member 125 for supporting the first and second permanent magnets such that the outer surface of the first and second permanent magnets 121 and 122 is separated a predetermined distance from the coil 123, and for transmitting vibrations of the first and second permanent magnets 121 and 122 to the case 124.

The coil 123 is coupled to the internal coupling coil 24 by a wire 24*a*, as shown in FIG. 3. It is preferable that the wire 24*a* is coated with a biocompatible polymer, such as polyurethane.

The case 124 includes cylindrical outer and inner bodies 124*a* and 124*b*. The outer body 124*a* has first and second lids 124*c* and 124*d*. It is preferable that the coil 123 is accommodated between the outer and inner bodies 124*a* and 124*b*. Because the case 124 is sealed by the outer body 124*a* and the first and second lids 124*c* and 124*d*, the first and second permanent magnets 121 and 122 and the coil 123, which are installed in the case 124, are protected from external foreign substances. It is preferable that the case 124 is formed of a biocompatible material, such as titanium, stainless steel, alumina, or polycarbonates.

The vibration member 125 includes a circular plate 125*a* interposed between the first and second permanent magnets 121 and 122, at the center of the inner body 124*b*, and supports 125*b* and 125*c* attached to the center of the circular plate 125*a* to support the near ends of the first and second permanent magnets 121 and 122, respectively. The supports 125*b* and 125*c* are elastic members for elastically supporting the first and second permanent magnets 121 and 122, such that the outer surfaces of the first and second permanent magnets 121 and 122 are separated a predetermined distance from the inner body 124*b* and the far ends of the first and second magnets 121 and 122 are a predetermined distance from the first and second lids 124*c* and 124*d*. As a consequence, the first and second permanent magnets 121 and 122 are suspended in the case 124 by the supports 125*b* and 125*c*. It is preferable that the vibration member 125 is formed of a biocompatible material with excellent elasticity, for example, silicon or polyamides. It is also preferable that rubbery members 125*d* and 125*e* are respectively interposed between the supports 125*b* and 125*c* and the first and second permanent magnets 121 and 122. In this case, mechanical vibrations of the first and second permanent magnets 121 and 122 can be effectively transmitted to the case 124.

Figure 1:
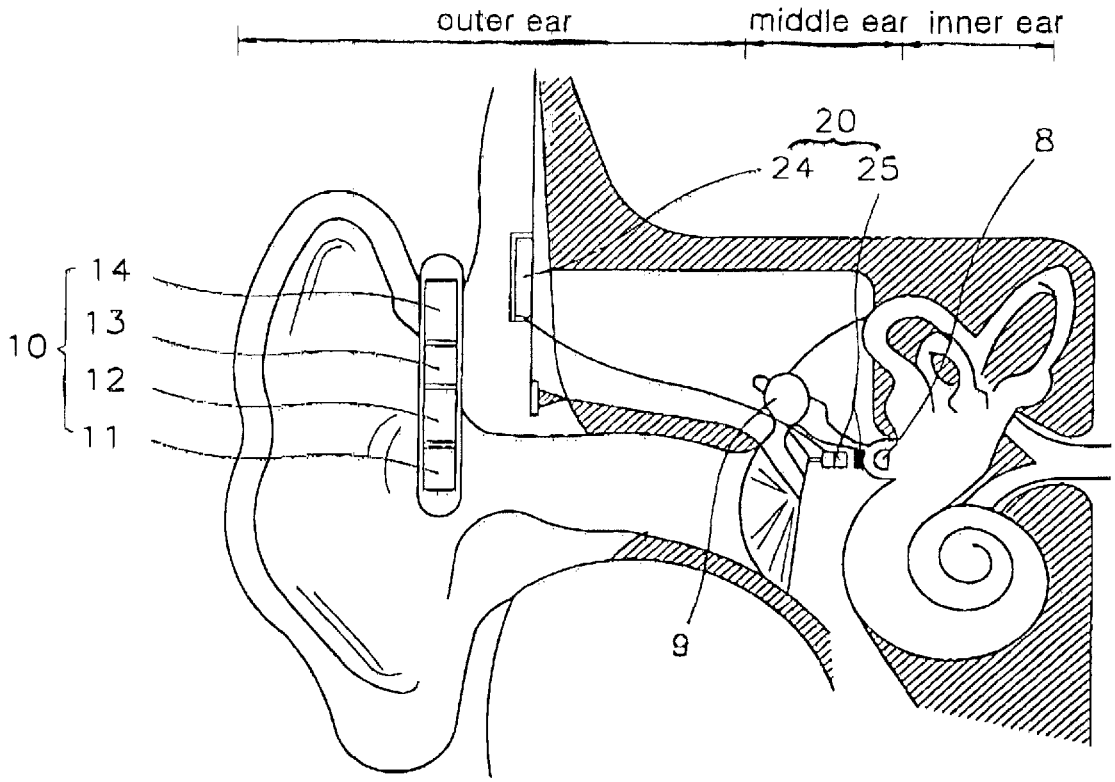
FIG. 1 (PRIOR ART)
FIG. 1 shows a conventional middle ear implantable hearing aid whose transducer is implanted into a patient's stapes.
Figure 2:
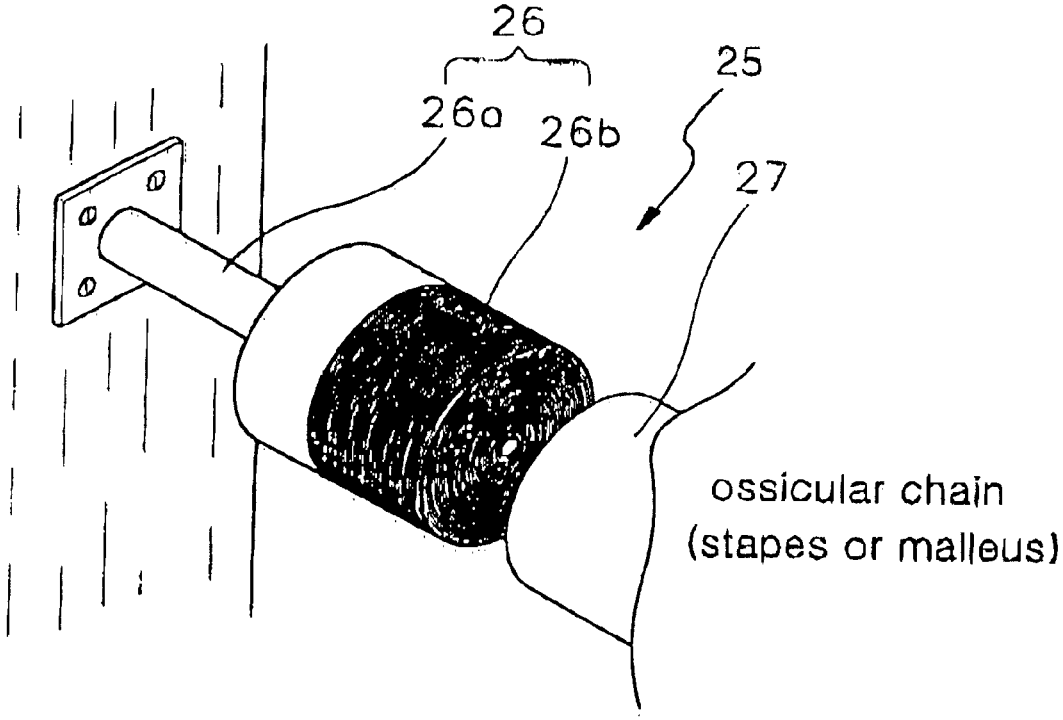
FIG. 2 (PRIOR ART)
FIG. 2 is a perspective view of the transducer of FIG. 1.
Figure 6:
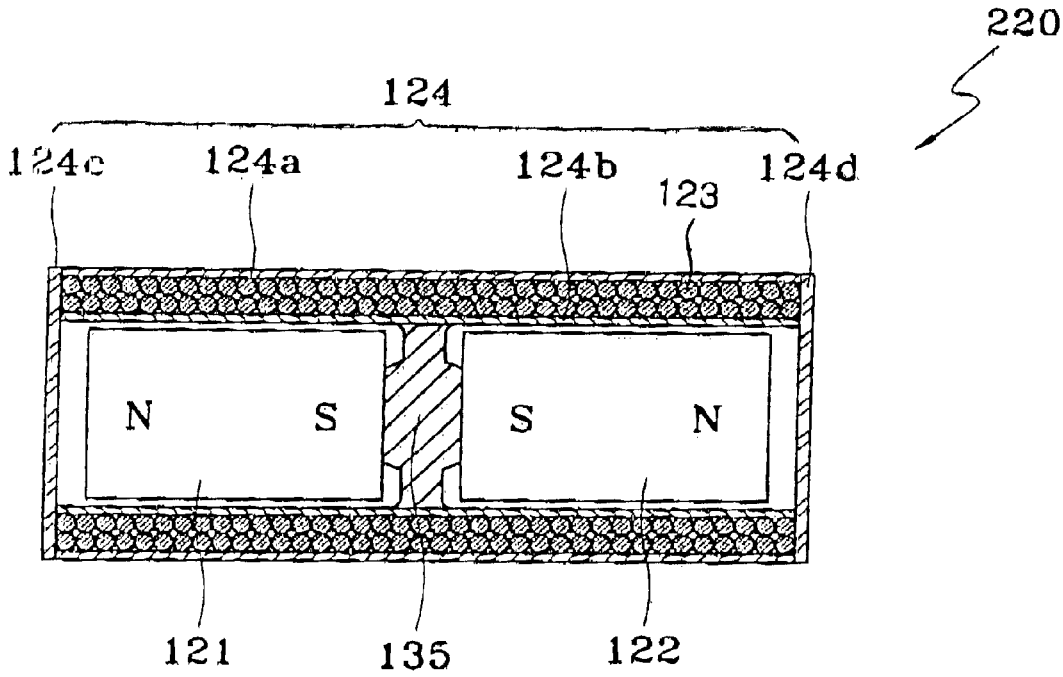
FIG. 6 is a sectional view of a second embodiment of the transducer of FIG. 3.

FIG. 6 is a sectional view of a second embodiment of the transducer of FIG. 2. In FIG. 6, the same elements as those of the first embodiment are represented by the same reference numerals. As shown in FIG. 6, the transducer 220 includes the first and second permanent magnets 121 and 122, the coil 123, the outer and inner bodies 124*a* and 124*b*, and the first and second lids 124*c* and 124*d*, which are the same as those of the first embodiment. The structure of a vibration member 135 is different from the vibration member 125 of the first embodiment. In particular, the vibration member 135 of FIG. 6 is an elastic member in which a circular plate and two supports are formed as a single unit. The vibration member 135 may be formed of silicon or polyamides. The vibration member 135 supports the first and second permanent magnets 121 and 122 so that the first and second permanent magnets 121 and 122 are separated from the coil 123 and suspended in the case 124.

Figure 7:
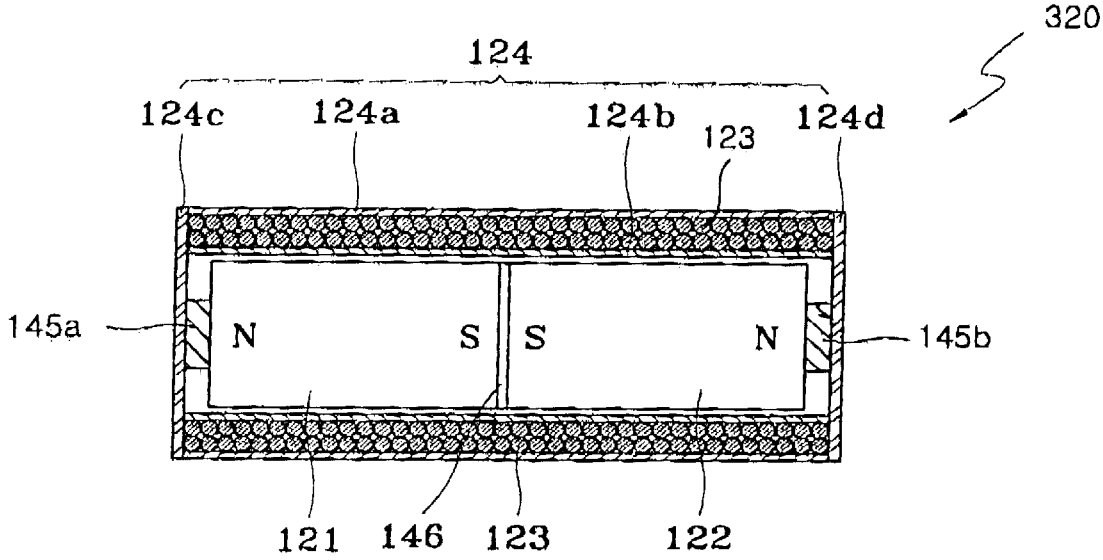
FIG. 7 is a sectional view of a third embodiment of the transducer of FIG. 3.

FIG. 7 is a sectional view of a third embodiment of the transducer of FIG. 3. In FIG. 7, the same elements as those of the first and second embodiments are represented by the same reference numerals. As shown in FIG. 7, the transducer 320 includes the first and second permanent magnets 121 and 122, the coil 123, the outer and inner bodies 124*a* and 124*b*, and the first and second lids 124*c* and 124*d*, which are the same as those of the first and second embodiments. The structure of a vibration member is different from the vibration members 125 and 135 of the first and second embodiments. In particular, the vibration member of FIG. 7 includes a first vibration member 145*a* for supporting the first permanent magnet 121 against the first lid 124*c* and a second vibration member 145*b* for supporting the second permanent magnet 122 against the second lid 124*d*. As a result, the first and second permanent magnets 121 and 122 are separated from the coil 23 and suspended in the case 124 by the first and second vibration members 145*a* and 145*b*, respectively. It is preferable that the first and second vibration members

145*a* and 145*b* are elastic members formed of a biocompatible material, for example, silicon or polyamides.

A partition 146 may be interposed between the first and second permanent magnets 121 and 122. It is preferable that the partition 146 is formed of a nonmagnetic material, such as epoxy or bakelite.

Figure 8:
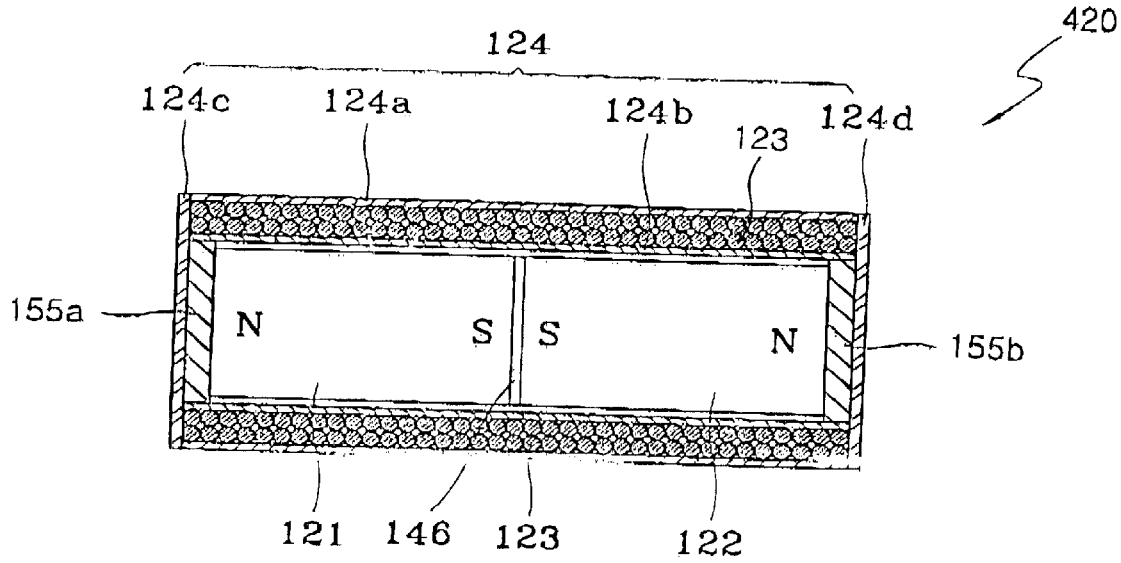
FIG. 8 is a sectional view of a fourth embodiment of the transducer of FIG. 3.
Figure 9:
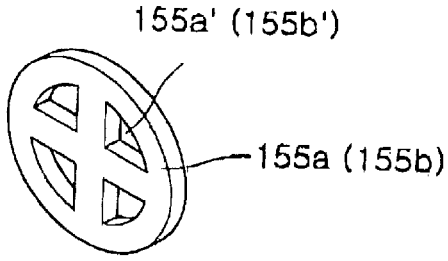
FIG. 9 is a perspective view of the vibration member of FIG. 8.

FIG. 8 is a sectional view of a fourth embodiment of the transducer of FIG. 3, and FIG. 9 is a perspective view of the vibration member of FIG. 8. The transducer 420 includes the first and second permanent magnets 121 and 122, the coil 123, the outer and inner bodies 124*a* and 124*b*, and the first and second lids 124*c* and 124*d*, which are the same as those of the first, second and third embodiments. The structure of a vibration member is different from the vibration members of the first, second and third embodiments 125, 135, 145. In particular, the vibration member of FIG. 8 includes a first vibration member 155*a* for supporting the first permanent magnet 121 against the first lid 124*c* and a second vibration member 155*b* for supporting the second permanent magnet 122 against the second lid 124*d*. The first and second vibration members 155*a* and 155*b* have almost the same diameter as the first and second permanent magnets 121 and 122 and a plurality of holes 155*a*' or 155*b*' to facilitate vibrations in the first and second vibration members 155*a* and 155*b*. As a result, the first and second permanent magnets 121 and 122 are separated from the coil 123 and suspended in the case 124 by the first and second vibration members 155*a* and 155*b*, respectively. It is preferable that the first and second vibration members 155*a* and 155*b* are elastic members formed of a biocompatible material, for example, silicon or polyamides.

The vibration members of the transducers according to the first through fourth embodiments of the present invention can be manufactured into a variety of shapes with a desired thickness by a known etching process, for example, a micromachining technique, which is extensively used in the manufacture of integrated circuits. These small vibration members can be manufactured on a large scale.

Figure 10:
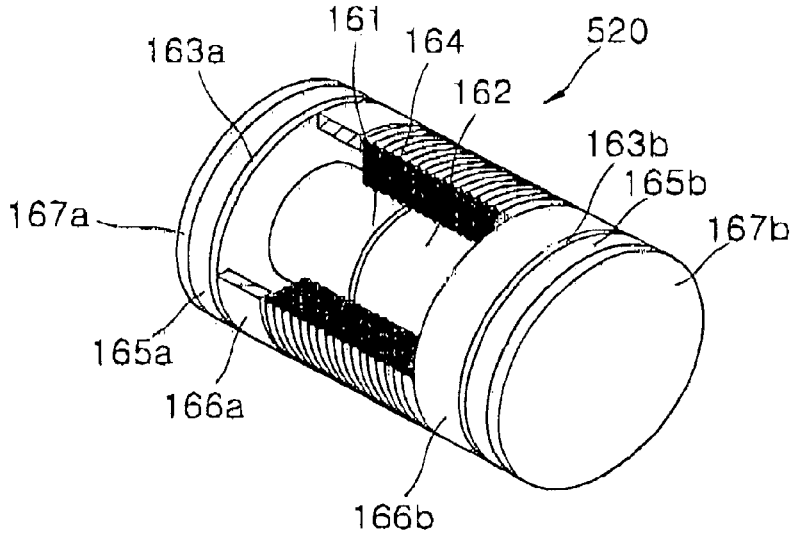
FIG. 10 is a perspective view of a fifth embodiment of the transducer of FIG. 3.
Figure 11:
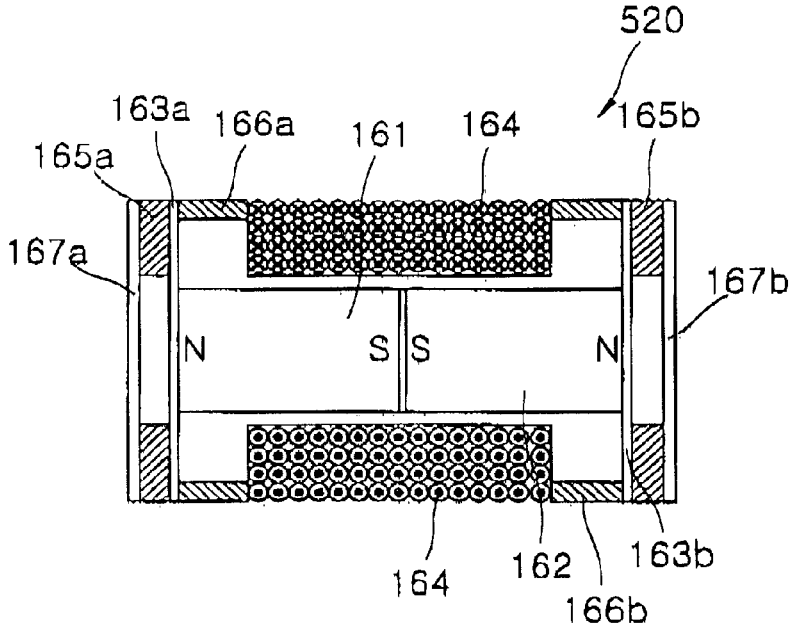
FIG. 11 is a sectional view of the transducer of FIG. 10.
Figure 12:
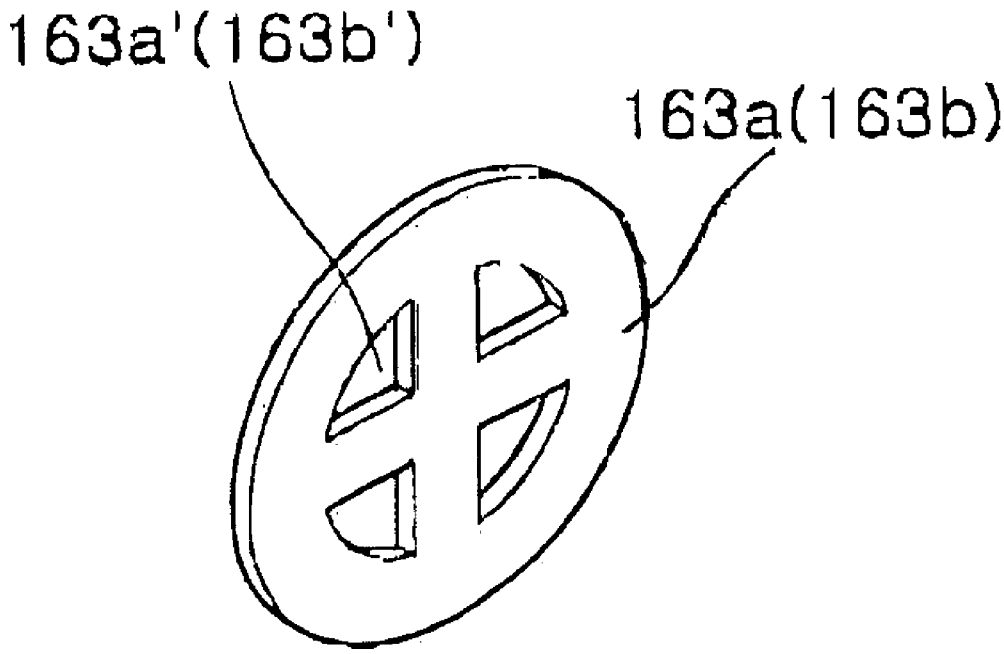
FIG. 12 is a perspective view of the vibration member of FIG. 10.

FIG. 10 is a perspective view of a fifth embodiment of the transducer of FIG. 3, FIG. 11 is a sectional view of the transducer of FIG. 10, and FIG. 12 is a perspective view of the vibration member of FIG. 10. The transducer 520 includes first and second permanent magnets 161 and 162, which are arranged such that the same poles face each other; first and second vibration members 163*a* and 163*b* whose diameter is larger than that of the first and second permanent magnets 161 and 162, attached to the far ends of the first and second permanent magnets 161 and 163, respectively; and a coil 164 separated a predetermined distance from the first and second permanent magnets 161 and 162 and surrounding the first and second permanent magnets 161 and 162 between the first and second vibration members 163*a* and 163*b*. First rings 165*a* and 165*b* are interposed between the first and second vibration members 163*a* and 163*b*, and the first and second lids 167*a* and 167*b*, respectively. Second rings 166*a* and 166*b*, which are not in contact with the outer surface of the first and second permanent magnets 161 and 162, are interposed between the coil 164 and each of the first and second vibration members 163*a* and 163*b*. The coil 164, the first rings 165*a* and 165*b*, and the second rings 166*a* and 166*b* may have the same diameter. It is also preferable that the first and second vibration members 163*a* and 163*b* have a plurality of holes 163*a*' and 163*b*' to facilitate vibrations in the same. The first and second vibration members 163*a* and 163*b* may be elastic members formed of a biocompatible material with excellent elasticity, for example, silicon or polyamides.

As described with reference to FIG. 3, the coil 164 is coupled to the inner coupling coil 24 by the wire 24*a*. It is preferable that the wire 24*a* is coated with a biocompatible polymer, such as polyurethane. In the present embodiment, the coil 164 is fully waterproof to prevent infiltration of fluid or foreign substances into the transducer. It is preferable that the first rings 165*a* and 165*b* and the second rings 166*a* and 166*b* are formed of a biocompatible material, such as titanium. The first and second lids 167*a* and 167*b* protect the first and second vibration members 163*a* and 163*b*, respectively, from the outside, and allow the first and second vibration members 163*a* and 163*b* to actively vibrate.

One end of the transducers according to the first through fifth embodiments is attached to the stapes 8 using a ceramic adhesive, which is a common medical adhesive. Although not illustrated, the transducers can be attached to the malleus 9 or a region between the incus (not shown)and stapes 8 of the ossicular chain in the middle ear.

In the middle ear hearing aid having the structure described above, the microphone 11 and the amplification circuitry 12 of the external unit 10 receive and amplify external sound waves. The amplified sound waves are transformed into electrical signal, and transmitted to the external coupling coil 14. The external coupling coil 14 generates electromagnetic waves corresponding to the electrical signals and transmits the electromagnetic waves to the inner coupling coil 24. The internal circuitry transforms the electromagnetic waves back into the corresponding electrical signals and transmits the electrical signals to the transducer. The electrical signals transmitted to the transducer is converted into a magnetic flux by the coil 123 (164).

Assuming that a current flows through the coil 123 (164) in a direction so that the right side of the drawings becomes the N pole and the left side becomes the S pole, the N pole of the second permanent magnet 122 (162) repels the N pole of the coil 123 (164), whereas the N pole of the first permanent magnet 121 (161) attracts the S pole of the coil 123 (164). Thus, the first and second permanent magnets 121 (161) and 122 (162) move toward the left. In contrast, in the case where a current flows the coil 123 (164) in the opposite direction, the direction of the induced magnetic field in the coil 123 (164) is also opposite, and the first and second permanent magnets 121 (161) and 122 (162), move toward the right. When an alternating current (AC) flows through the coil 123 (164), the first and second permanent magnets 121 (161) and 122 (162) vibrate at the same frequency as the AC signal, and the mechanical vibrations of the first and second permanent magnets 121 (161) and 122 (162) are transmitted to the case 124 or the first and second lids 167*a* and 167*b*.

Since the first and second permanent magnets 121 (161) and 122 (162) are arranged such that the same poles are close to and faces each other, earth's magnetic field, or any external magnetic field, for example, from power lines or a high-current home appliance, can be compensated for by arranging the first and second permanent magnets 121 (161) and 122 (162) such that the same poles face each other. As a result, unnecessary vibrations caused by external magnetic fields, which are perceived as noise, can be prevented.

The mechanical vibrations transmitted to the case 124 or the first and second lids 167*a* and 167 are transmitted to the stapes 8 or via the malleus 9 and/or the incus, so that the patient perceives sounds due to the vibrations.

Frequency characteristics of the transducer vary depending on the stiffness of the elastic vibration member. The frequency characteristics can be varied by adjusting the size and thickness of the vibration member. The quality of the transducer can be controlled by finely adjusting characteristics of the transducer. As a result of an experiment conducted by the present inventor, the transducer according to the present invention has a dynamic frequency range from tens of Hertzes to six kiloHertzes.

As described previously, the middle ear hearing aid transducer according to the present invention can prevent noise caused by an external magnetic field by arranging the first and second permanent magnets such that the same poles thereof face each other. In addition, the transducer is attached to the ossicular chain, without need for implantation, so that load to the ossicular chain decreases. As a result, deformation of the sound wave transmission path reaching the inner ear can be prevented. The gap between the coil and the permanent magnets can be kept constant by the vibration member so that sensitivity of the transducer to external sound waves can be maintained even after extensive use. The transducer is introduced to the middle ear using an adhesive, so there is no need to shave off part of a bone of the middle ear and implant other parts, such as a coil support, into the bone. The transducer according to the present invention can be introduced into the middle ear by a simple surgery.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A middle ear hearing aid transducer, comprising:

first and second permanent magnets, a magnetic pole of said first magnet being positioned to face a magnetic pole of said second magnet, said facing poles being of the same polarity;

first and second vibration members each being attached to an end of one of the first and second permanent magnets and having a diameter larger than the first and second permanent magnets;

a coil being spaced by a predetermined distance from outer surfaces of the first and second permanent magnets, and surrounding the first and second permanent magnets;

first rings installed outward of the first and second vibration members; and lids installed outward of the first rings.

2. The middle ear hearing aid transducer of claim 1, further comprising second rings interposed between the coil and the first and second vibration members, and spaced from the outer surfaces of the first and second permanent magnets.

3. The middle ear hearing aid transducer of claim 1, wherein the first and second vibration members are elastic members having a plurality of holes.

4. A hearing aid transducer, comprising:

a tubular case;

a coil disposed within and supported by said case;

at least one magnet surrounded by said coil; and an elastic vibrating member disposed between said magnet and said case, said elastic vibrating member physically connecting said magnet with said case for transmitting vibrations of said magnet to said case;

wherein said magnet is suspended, by said elastic vibrating member, within said case without any direct physical contact with said coil and said case;

said magnet has two opposite longitudinal ends defining two magnetic poles of said magnet, respectively, one of said longitudinal ends being attached to said elastic vibrating member while the other longitudinal end being suspended within said coil;

said elastic vibrating member is physically attached to a middle portion of said case;

said transducer comprises two said magnets extending, in opposite directions, from said elastic vibrating member toward opposite axial ends of said tubular case, respectively; and the magnetic poles of said magnets, which poles are attached to said elastic vibrating member, are of the same polarity.

5. A hearing aid transducer, comprising:

a tubular case;

a coil disposed within and supported by said case;

at least one magnet surrounded by said coil; and an elastic vibrating member disposed between said magnet and said case, said elastic vibrating member physically connecting said magnet with said case for transmitting vibrations of said magnet to said case;

wherein said magnet is suspended, by said elastic vibrating member, within said case without any direct physical contact with said coil and said case;

said magnet has two opposite longitudinal ends defining two magnetic poles of said magnet, respectively, one of said longitudinal ends being attached to said elastic vibrating member while the other longitudinal end being suspended within said coil;

said transducer comprises two said elastic vibrating members each being physically attached to one of opposite axial ends of said tubular case;

said transducer comprises two said magnets each extending from one of said elastic vibrating members toward a central axial region of said tubular case; and the magnetic poles of said magnets, which poles are not attached to said elastic vibrating members, are of the same polarity.

6. The transducer of claim 5, wherein the magnetic poles of said magnets, which poles are not attached to said elastic vibrating members, are spaced by a gap; and said magnetic poles of said magnets are not physically connected to each other by an object disposed in said gap.

7. A hearing aid transducer, comprising:

a tubular case;

a coil disposed within and supported by said case;

at least one magnet surrounded by said coil; and an elastic vibrating member disposed between said magnet and said case, said elastic vibrating member physically connecting said magnet with said case for transmitting vibrations of said magnet to said case;

wherein said magnet is suspended, by said elastic vibrating member, within said case without any direct physical contact with said coil and said case;

said transducer comprises two said magnets both of which are moveable axially of said tubular case due to elasticity of said elastic vibrating member; and both said magnets move in a first direction when said coil is magnetized to have a first magnetic polarization and both said magnets move in an opposite, second direction when said coil is magnetized to have an opposite, second magnetic polarization.

* * * * *